US005699957A

United States Patent [19]

Blin et al.

[11] Patent Number: 5,699,957

[45] Date of Patent: Dec. 23, 1997

[54] MULTIPLE COMPARTMENT SEPARABLE CONTAINER

[75] Inventors: Patrick Blin; Jean-Yves Daniel; Alain Saulas, all of Chateauroux, France

[73] Assignee: The Mead Corporation, Dayton, Ohio

[21] Appl. No.: 535,283

[22] PCT Filed: Apr. 15, 1994

[86] PCT No.: PCT/US94/04200

§ 371 Date: Apr. 19, 1996

§ 102(e) Date: Apr. 19, 1996

[87] PCT Pub. No.: WO94/24005

PCT Pub. Date: Oct. 27, 1994

[30] Foreign Application Priority Data

Apr. 21, 1993 [GB] United Kingdom ..... 9308518

[51] Int. Cl.[6] ..... B65D 5/46

[52] U.S. Cl. ..... 229/117.12; 229/120.011; 229/120.17; 206/192

[58] Field of Search ..... 229/120.011, 120.17, 229/235, 240, 906, 117.12; 206/192, 187, 175, 170

[56] References Cited

U.S. PATENT DOCUMENTS

| | | | |
|---|---|---|---|
| 2,973,130 | 2/1961 | Cottrill | 229/120.011 |
| 3,677,458 | 7/1972 | Gosling | 229/120.011 |
| 4,039,120 | 8/1977 | Herzog | 229/235 |
| 4,467,293 | 8/1984 | Dornbusch et al. | 206/602 |
| 4,533,052 | 8/1985 | Fruchey et al. | 206/602 |
| 4,778,057 | 10/1988 | Allen et al. | 206/602 |
| 4,905,837 | 3/1990 | Schusker et al. | 229/120.011 |
| 4,919,269 | 4/1990 | Wright et al. | 206/602 |
| 5,178,269 | 1/1993 | Evers | 229/120.011 X |
| 5,299,733 | 4/1994 | Werth | 229/120.011 |

*Primary Examiner*—Allan N. Shoap
*Assistant Examiner*—Christopher J. McDonald
*Attorney, Agent, or Firm*—Tsughiko Suzuki

[57] ABSTRACT

A multi-compartment container for packaging a plurality of articles such as bottles, comprises two or more compartment units and a frangible connecting portion. Each compartment unit comprises a base panel, opposed side panels, opposed end panels and a top panel. Certain adjacent panels of the compartment units partly provide the frangible connecting portion so that removal of the connecting portion causes at least partial separation of the units and provides access for removal of the articles contained in the units. Upon removal of the connecting portion, at least a part of each panel of each compartment unit remains intact.

10 Claims, 7 Drawing Sheets

MULTIPLE COMPARTMENT SEPARABLE CONTAINER

This invention relates to a multiple compartment, separable container. The container is formed to include multiple article receiving compartments which together provide a single carton unit adapted to be carried by a purchaser but which can be separated one from the next to form a plurality of carton compartment units.

U.S. Pat. No. 4,919,269 discloses a multiple compartment container which has two compartments each holding twelve beverage cans. The entire carton of twenty four cans may be easily transported. The carton is capable of being split to produce two individual carton units having twelve cans each. The separation of the individual compartments may be done at the point of sale so that smaller quantities of the product may be sold, or may be performed later by the purchaser at his convenience. In the multiple compartment container disclosed in this reference, separation of the individual containers one from the other does not cause either one of the separated containers to be opened but merely detaches the units so that they are separated from one another.

According to an aspect of the present invention there is preferably provided a multi compartment container for packaging a plurality of articles, such as bottles, which comprises two or more compartment units and a frangible connecting portion, said compartment units comprising a number of faces provided by a base panel, opposed side panels, opposed end panels and a top panel wherein certain adjacent panels of each of said compartment units are partly formed by said frangible connecting portion in said formed multi-compartment container and wherein removal of said connecting portion from said container causes at least partial separation of said units and provides access for removal of at least one of the articles contained in at least one of said units, wherein upon removal of said connecting portion at least part of each of said panel faces of each of said compartment units remains intact.

According to a feature of the invention, said adjacent panels may be top panels of respective ones of said units and said connecting portion is a cover portion of said container which bridges said units. In a preferred form the removal of the cover portion exposes at least one article in each of the compartment units thereby enabling removal of the one article form each of the units. Additionally, the compartment units preferably are attached in the formed container by a second frangible attachment means which may be a connecting tab which is frangibly hinged to one compartment unit of an adjacent pair of units and secured to the other unit of the adjacent pair.

In another preferred form of the invention the multi compartment container comprises at least one pair of adjacent compartment units in side by side relationship wherein a side panel of each of said units forms a keel in the base of the formed container which separates articles in each of the units of the adjacent pair.

In a further preferred form of the invention the cover portion comprises a handle for carrying the formed container. Also, the cover portion may comprise end tabs which are hingably attached to the cover portion and which tabs can be grasped and pulled thereby to remove said cover portion from the container. In a further preferred form of the invention a compartment unit comprises a frangible flap which is attached to a cover portion end tab and also frangibly hinged to an end panel of the compartment unit in the formed carton thereby providing additional attachment means between the compartment unit and the cover portion.

In a preferred form of the invention the cover portion is frangibly joined to the compartment units in the formed container along a perforate line which transverses the top of a compartment unit into an end panel thereof. Preferably the multi-compartment container is made from a single blank.

In another form the invention provides a multi-compartment container for packaging a plurality of articles such as bottles, comprises two or more compartment units and a frangible connecting portion said compartment units comprising a number of panel faces provided by a base panel, opposed side panels and opposed end panels wherein certain adjacent walls of each of said compartment units partly comprise said frangible connecting portion in said formed multi-compartment container, and wherein removal of said connecting portion from said container causes at least partial separation of said units and provides access for removal of at least one of the articles contained in at least one of said units wherein upon removal of said connecting portion at least part of each of said panel faces of each of said compartment units remain intact.

In this form each compartment may comprise means for cooperating with one or more of the articles so as to enable a separated compartment to be stored on its side. In a preferred form the cooperating means is an article dividing structure and in another preferred form it is a compartment top panel.

Containers embodying the invention in the form of a paperboard carton will now be described, by way of example only, with reference to the accompanying drawings, in which.

Figure 1:
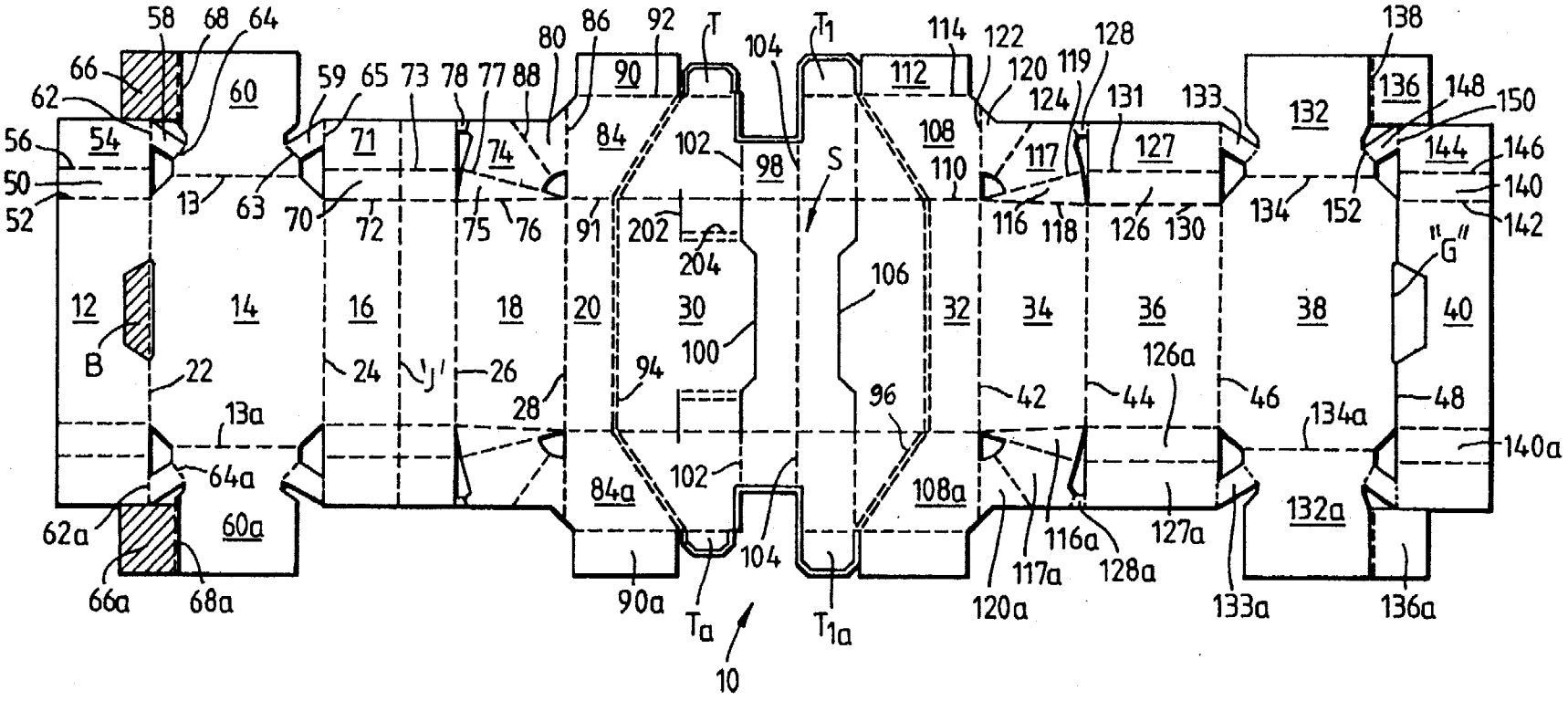
FIG. 1 is a plan view of a blank from which a carton according to the invention is formed.
Figure 2:
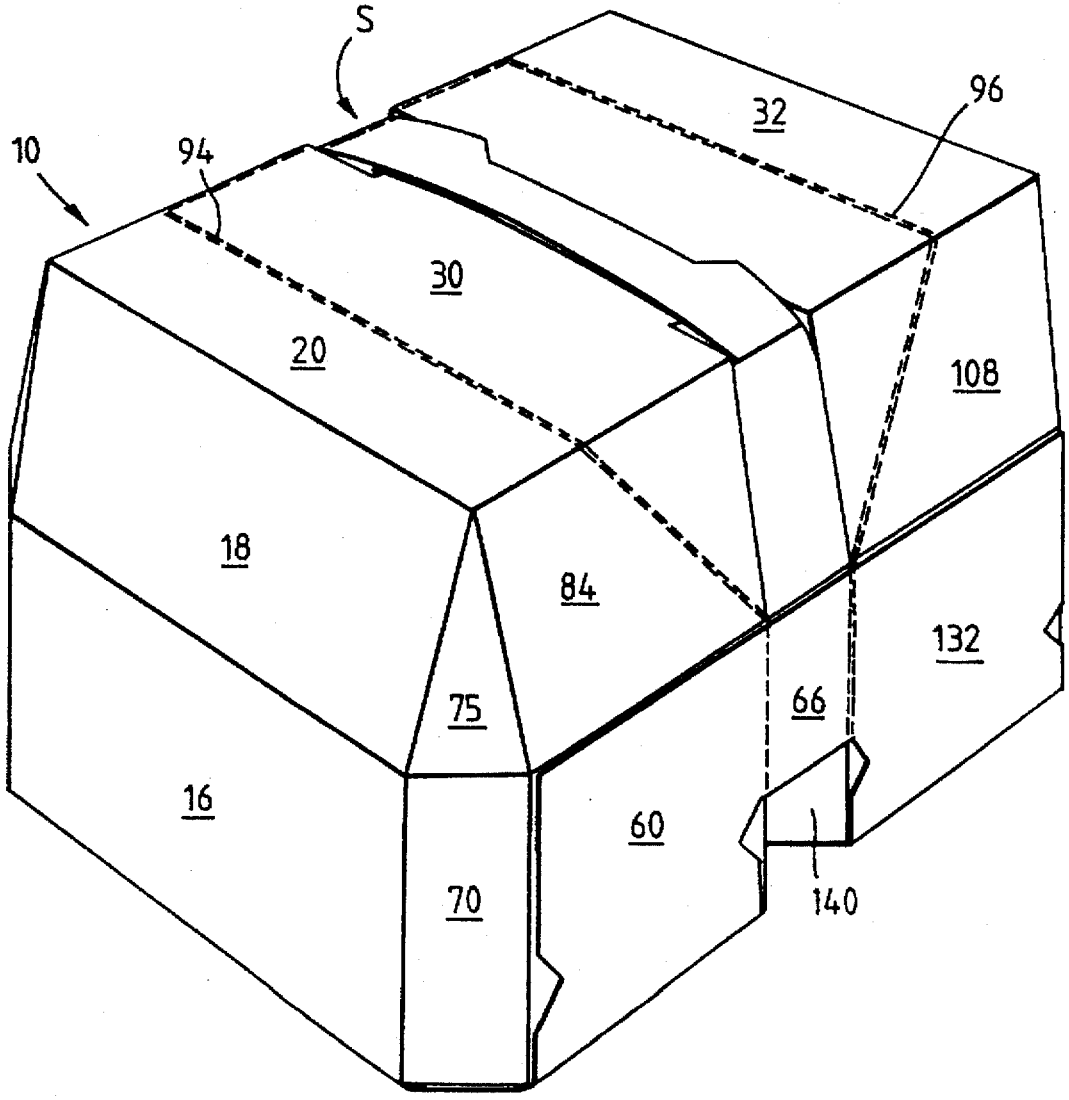
FIG. 2 is a perspective view taken from above and from one end of a carton formed from the blank shown in FIG. 1 and subsequently loaded with articles.

Referring to the drawings, and in particular to FIG. 1, a carton blank 10 formed from paperboard or similar foldable sheet material comprises, in series, a first inner side wall panel 12, a first base panel 14, a first lower side wall panel 16, a first upper side wall panel 18, a first top wall 20 hinged one to the next along transverse fold lines 22, 24, 26 and 28 respectively. The top wall 20 forms a part of a handle structure generally designated by the reference numeral "S" which is incorporated within a removable panel 30 which is described in more detail later.

The second module of the container is of similar construction to that described above and includes a plurality of main panels hinged in series including a top panel 32, which is similar to panel 20, a second upper side wall panel 34, a second lower side wall panel 36, a second base panel 38 and a second inner side wall panel 40 hinged one to the next along transverse fold lines 42, 44, 46 and 48 respectively.

The blank is symmetrical about its longitudinal central axis and therefore those panels which are hinged to the longitudinal edges of the main panels 12 to 20, 30 and 32 to 40 will be described with reference to one edge of the blank only, the opposite and like panels on the opposite longitudinal edge of the blank being designated like reference numerals with the addition of suffix "a".

The first inner side wall panel 12 carries an integral corner "bevelled" panel 50 hinged along longitudinal fold line 52 to panel 12 and a glue flap 54 is joined to bevelled panel 50 along fold line 56. The glue flap 54 is hinged by means of a gusset panel 58 to one edge of a lower end wall panel 60, gusset panel 58 being hinged to glue flap 54 by a transverse fold line 62 and to the lower end wall panel along an inclined fold line 64. The lower end wall panel itself carries a foldable glue flap 66 which is frangibly joined to lower end wall panel 60 along a perforated line 68.

Another end panel structural component comprises a corner panel 70 which is hinged to the longitudinal edge of first lower side wall panel 16 along longitudinal fold line 72. Corner panel 70 is hinged to a glue flap 71 along a fold line 73. A further corner panel 75 is hinged to the longitudinal edge of upper side wall panel 18 along longitudinal fold line 76 and to an inner structural panel 74 along fold line 77. Panels 71 and 74 are joined together by hinged gusset panel 78. A further gusset panel 80 hingably connects panel 74 to upper end panel 84 to which it is hinged by means of fold line 86. Gusset 80 is hinged to panel 74 along fold line 88. At its extreme end the upper end panel 84 carries a glue flap 90 which is hinged to the upper end wall panel along fold line 92. Upper end panel 84 is hinged to one longitudinal edge of the top panel 20 along longitudinal fold line 91.

When the carton is formed the glue flap 71 is secured to the free edge of lower end wall panel 60 internally of the carton so that together panels 60 and 84 form the substantial portion of the end portion of the module. Corner panels 70 and 75 form a bevelled corner section between the side wall panels 16 and 18, and the end wall panels 60 and 84 in the formed carton.

Panels 20, 84, 90, **84*a*, 90*a* are frangibly connected to a removable panel 30 by means of a frangible connection 94 extending transversely across blank 10. Similarly, the opposite end of the removable panel 30 has a frangible connection 96 to top panel 32 and its dependent panels. It can be seen that removable panel 30** has top and end panels.

As referred to above, a handle structure "s" is formed within the removable top and side panel 30 and preferably takes the form of the extensible handle described and claimed in European patent application no. 89304604.5. To this end the handle structure "s" includes a reinforcing panel 98 which is hinged to the transverse left and right of a handle opening slot 100 along an interrupted transverse fold line 102. A similar handle slot 106 is struck from the removable panel 30 between the transverse fold line 104 and the frangible connection between panel 30 and top panel 32. A relatively short transverse slit 202 is also cut parallel to slot 100 in top cover 30. The slit 202 and parallel longitudinal fold lines 204 provides a means of reducing stress in the carton when lifted by the handle.

The right hand side of the blank, as viewed in FIG. 1, is of similar arrangement to that on the left hand side of transverse frangible connection 94 and, of course, comprises components of the blank which form the second similar but separable module of the container.

Thus second upper end panel 108 is hinged to top panel 32 along longitudinal fold line 110. A glue flap 112 is hinged to the end edge of panel 108 along longitudinal fold line 114. A second upper end panel 116 is hinged along a longitudinal edge of upper side panel 34 along fold line 118. Panel 116 forms a bevelled corner panel in the formed carton and is hinged to an inner structural panel 117 along fold line 119. Panel 117 is connected to panel 108 by means of gusset panel 120. Gusset panel 120 is hinged to upper end wall panel 108 along transverse fold line 122 and is hinged to inner panel 117 along oblique fold line 124.

Lower end corner panel 126 is foldably joined to second lower side wall panel 36 along longitudinal fold line 130, and to an inner glue panel 127 along fold line 131. Panel 127 is connected to panel 117 by gusset 128 and to second lower side wall 132 by gusset 133.

Second lower end wall panel 132 is hinged to second bottom wall 38 along longitudinal fold line 134 and includes a frangible glue flap 136 which is hinged to panel 132 along perforated line 138. Second end panel 40 has hinged thereto a corner bevelled panel 140 foldably joined along longitudinal fold line 142 and glue flap 144 which is hinged to the bevelled panel along longitudinal fold line 146. Glue flap 144 is connected to second lower end panel 132 by means of a gusset panel 148 hinged to the glue panel 144 along fold line 150 and to lower end panel 132 along inclined fold line 152.

In order to form the blank into a collapsed sleeve which can then be erected and end loaded by means known in the art, first the handle panel 98 is folded through 180° to the right (as viewed in FIG. 1) about fold line 104 and adhered to portions of the blank between the handle cut 106 and fold line 104 and between the lateral extremes of end tabs $T_1$ and $T_{1A}$. This brings end tab T into face to face contact with end tab $T_1$.

The portions of the blank to the right hand side of transverse fold line 44 are folded through 180° to the left. First lower inner panel 12 and adjoining lateral panels thereto, namely panels 50, **50*a*, 54, and 54*a*, are folded 180° to the right about fold lines 22 and 62 and 62*a*. Base tab "B" remains in its flat position shown in FIG. 1. After an application of glue is made to glue flap 66 and base tab "B", the blank to the left hand side of fold line "F" is folded through 180° to the right into overlapping relationship with parts of the exposed face the other folded portion of the blank. Thus glue flap 66 and base flap "B" are adhered to glue flap 136 and a portion of base 38 adjacent aperture "G" respectively. Similarly, glue flap 66*a* adheres to second glue flap 136*a***.

The blank is now in a partly formed, flat folded condition from which it can be erected and loaded. The carton is loaded when in a sleeve-like form in a manner well known in the art. During loading inner side wall panels 12 and 40 are maintained in an upright position and act to separate one portion of the carton from another and thus divide the packaged articles into the two sections which form separable modules. It should be noted however, that during formation of the sleeve the two inner side wall panels 12 and 40 are brought into face to face relationship but unsecured internally of the sleeve. It is the flap "B" and the frangible glue flaps 66, 136 which are responsible for securing together the two opposite ends of the container blank 10.

To close the ends of the sleeve after loading has taken place is relatively conventional. The corner panels 70, 75, 116 and 126, structural panels 74 and 117, and glue flaps 71 and 127 are folded inwardly about fold lines 72, 76, 130, 118, 77, 119, 73 and 131 respectively. Upper end closure panels 84 and 108 are then folded downwardly about fold lines 95 and 110 respectively into overlapping relationship with panels 74, 71, 117 and 127.

Lower end panel 60 is then folded upwardly about the folded connection with base panel 14 and adhered to panels 71, 74, 90 and 54. Similarly, lower end panel 132 is raised about fold line 134 and adhered to panels 127, 117, 112, and 144 to complete the end of the carton.

Figure 3:
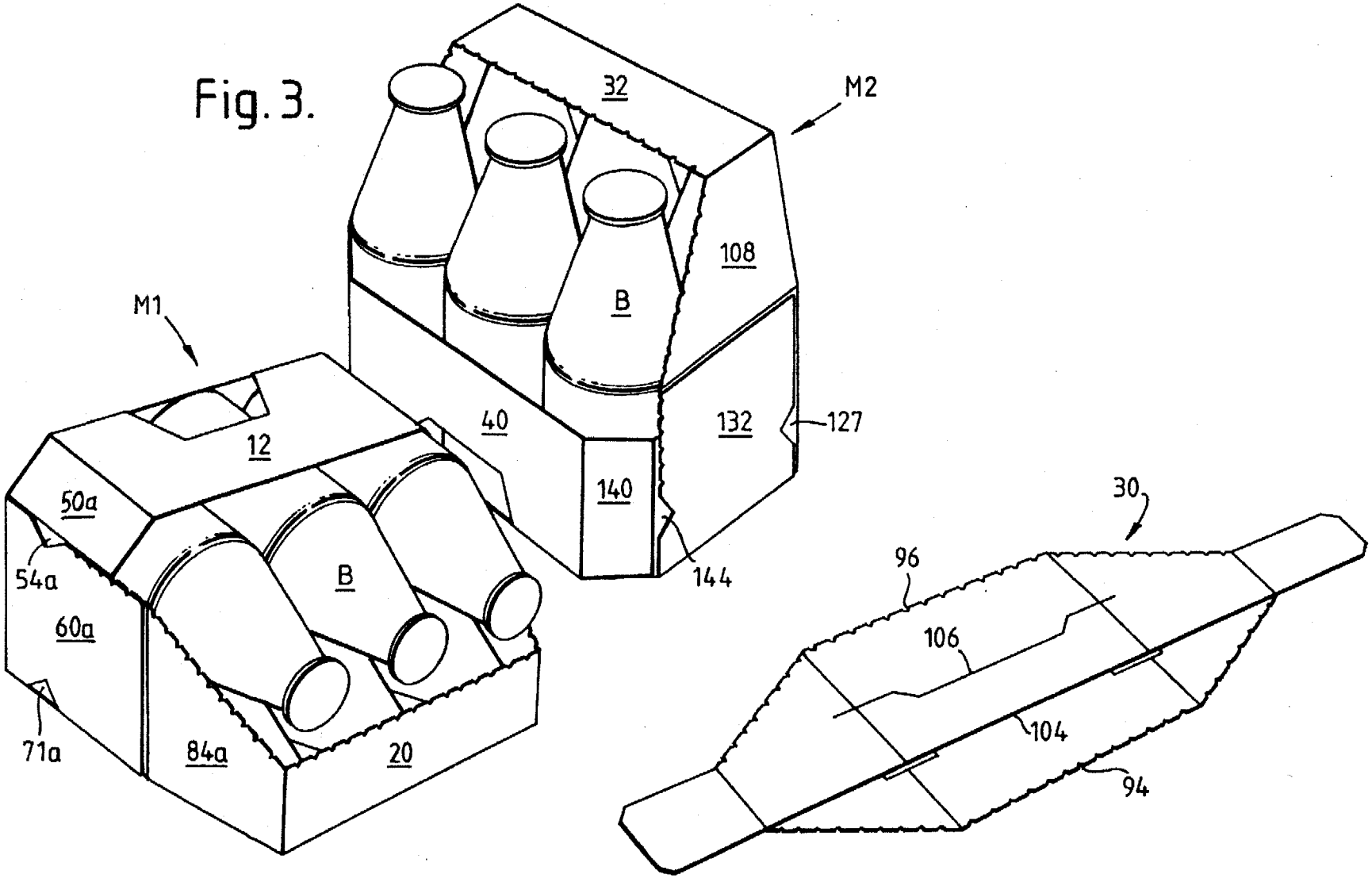
FIG. 3 is a perspective sketch showing the two separated individual container units and the strip of material which is removed from the initial single unit carton to cause separation into the individual container units.

In order to open the carton the large tabs T and, $T_1$ which are overlapped by frangible glue flap 66, 136 are grasped and pulled and the whole of the frangible top section 30 which includes handle structure S and defined substantially by frangible perforated lines 94, 96 can be torn away thereby exposing the contents of the carton and removing portions of the opposite ends and top wall. A pair of individual containers can then be separated from one another by tearing away the frangible glue flap B from the base of the mating module thus leaving the two modules M1 and M2 as depicted in FIG. 3 of the drawings. As can be readily seen these modules allow the contents to be retained within a container in a stored position but also allow access to the contents for immediate use. Thus access to the bottles B can be readily gained without the necessity of removing any other part of the container beyond the central frangible strip which is removed to cause separation of the modules. After separation, the modules may be stored upright as is module M2 in FIG. 3 and also the modules may be laid on their sides. As shown in FIG. 3 module, M1 is laid on its side while top panel 20, upper end panels 84 and 84*a*, and upper side panel 18 help retain the bottles B.

The modules can be placed one at a time or indeed side by side in a refrigerator shelf such as the shelf present in a refrigerator door and the bottles conveniently dispensed from the exposed face of the container. The individual modules also provide a convenient container by which the empty bottles can be returned to a retailer or collection depot.

Figure 4:
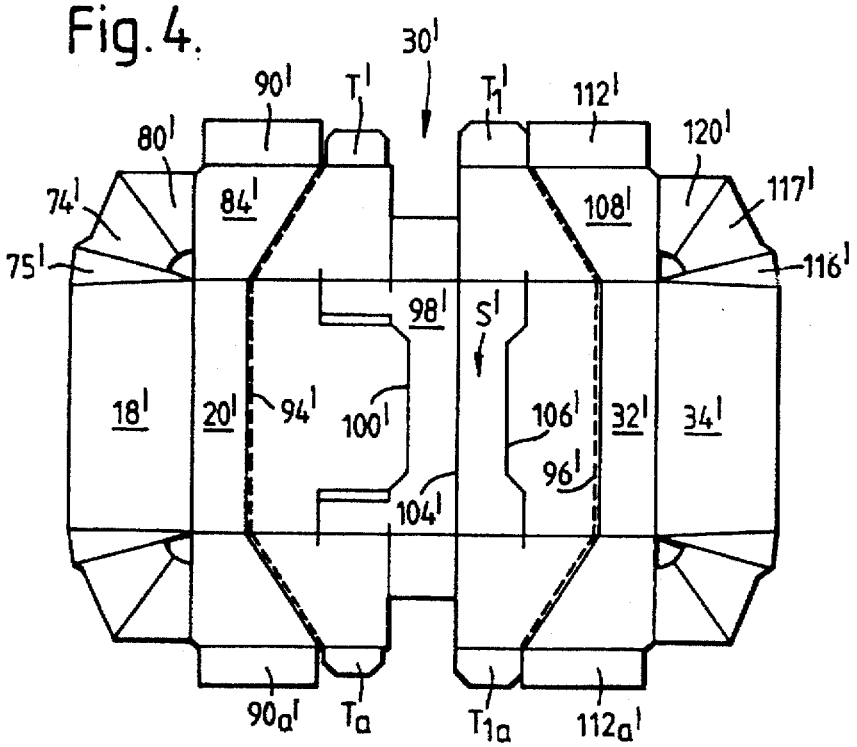
FIG. 4 is a plan view of a separate cover portion which is used to form a second embodiment of the invention.
Figure 5:
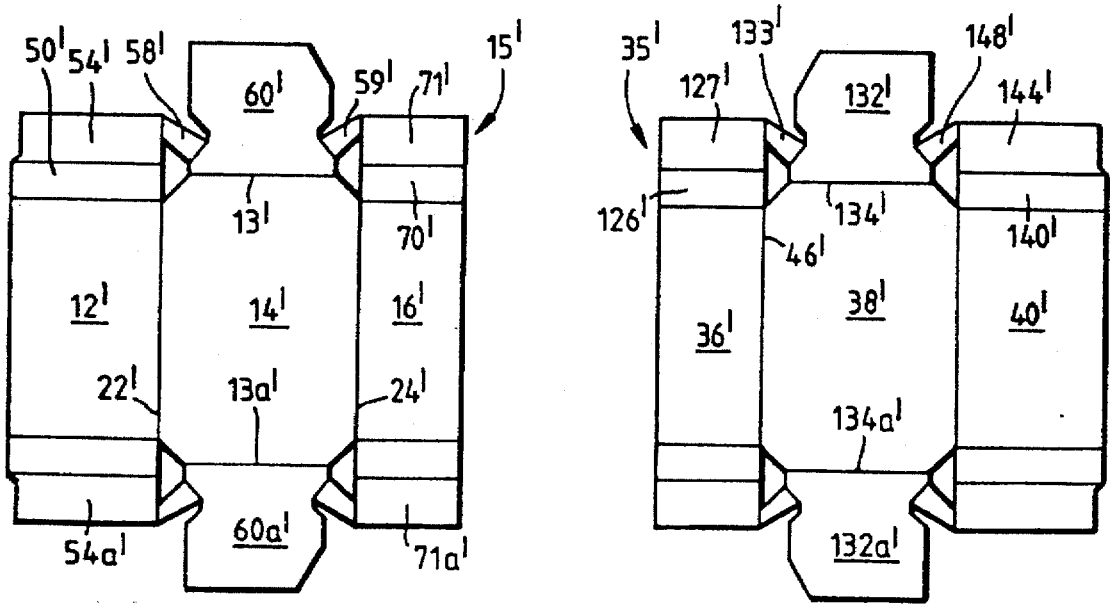
FIG. 5 is a plan view of blanks used to form compartments which together with the cover portion shown in FIG. 4 make up a second embodiment of the invention.
Figure 6:
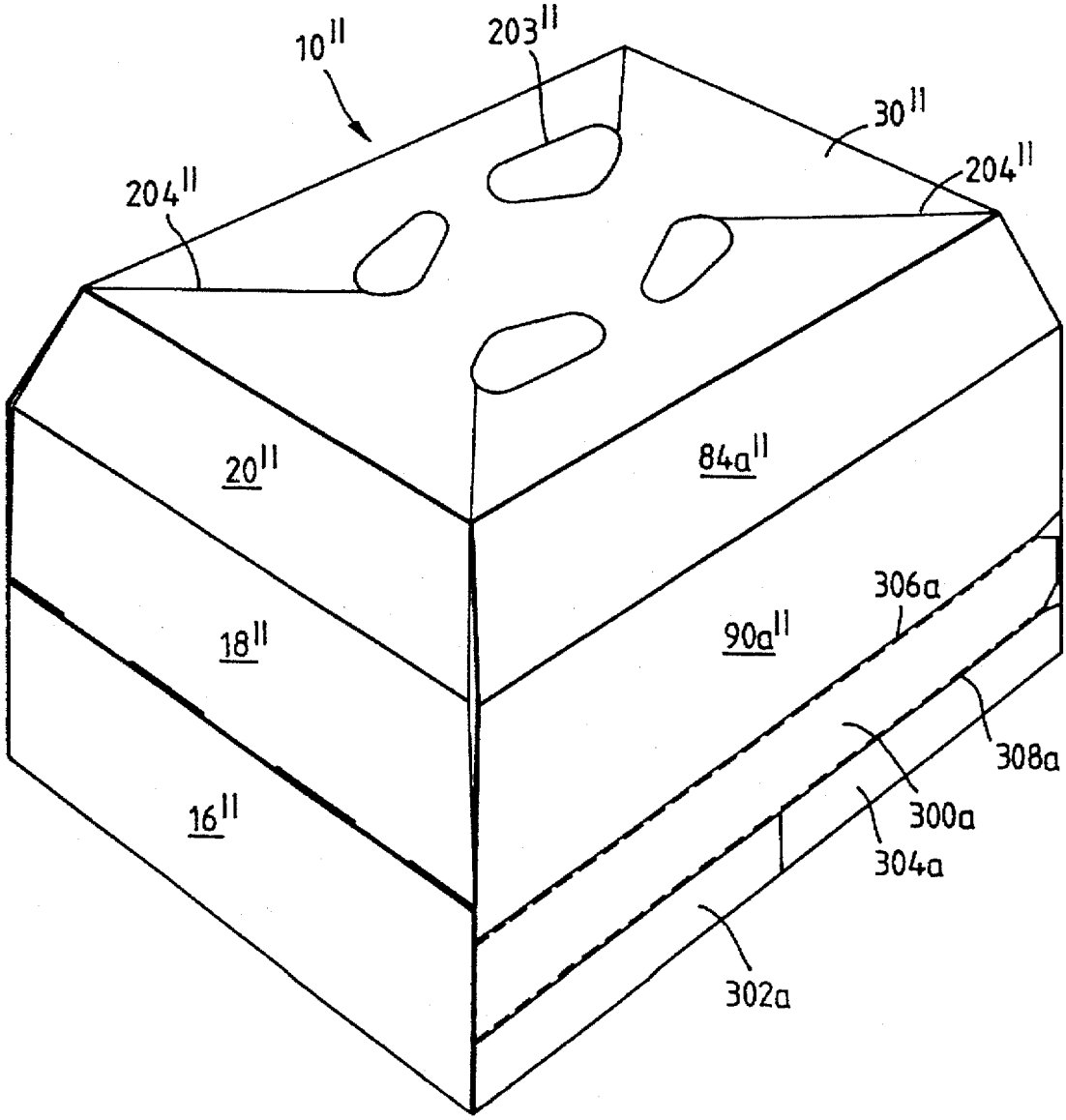
FIG. 6 is a perspective view of a container according to a further embodiment of the invention.

Whilst it is preferable to form a container according to the invention from a unitary blank such as blank 10 shown in FIG. 1 it is possible for example to provide a separable multi-compartment container which when formed appears substantially like the container shown in FI. 2 but which is comprised of a separate cover portion 31' and separate blanks 15' and 35', the latter of which form the tray-like components or modules, as shown in unformed plan views in FIGS. 4 and 5.

It can readily be seen that in order to form a container 10' (not shown assembled) using portions 31', 15' and 35', the latter compartments should be formed, for example in the case of compartment 15', by raising side panels 12' and 16' and folding glue flaps 54', 54*a'*, 71' and 71A' inwardly. This is followed by raising end panels 60' and 60A' and adhering these to said glue panels to form a tray-like structure. Similarly compartment 35' is formed in a like manner.

To form a completed container 10', cover portion 31' is first folded to form a reinforced handle S' in a manner similar to that previously described with relation to the handle of frangible connection portion 30 of the first embodiment of the invention. Thus the handle portion 98' is folded about fold line 104' so that it can be glued to the portion between fold line 104' and cut 106'. The cover portion 31 is then lowered onto compartments 15' and 35' and adhered thereto for example by gluing glue flap 90' to the outside surface of end panel 60' of compartment 15' and repeating this for all glue flaps.

Side wall 18' of cover portion 31' can further be adhered to side wall panel 12' on the inside or outside surface thereof. Alternatively it might not be necessary to adhere panels 18' and 12' in which case it is appropriate to tuck panel 18' inside the compartment 15'—the container being formed by gluing all the panels 90', 112', 98' and 112A' to their respective compartments 15' and 35'.

To separate the compartments from the container the removable panel 30' is torn away from the container in a manner described in relation to the first embodiment. That is, the tags T1 and T1' may be pulled so as to cause frangible lines 94' and 96' to tear.

A further embodiment of a container according to the invention is shown in FIGS. 6, 7, 8 & 9. In this embodiment two compartments 15" and 35" are made from separate blanks and comprise article dividers as clearly shown in FIG. 7. The container 10" also comprises a separate cover portion 31" which comprises removable panel 30" shown in FIG. 9. There is therefore provided in the third embodiment of the invention a two compartment separable container wherein each compartment holds six bottles in a two by three array, each bottle having its own receiving section divided from adjacent bottles.

Figure 8:
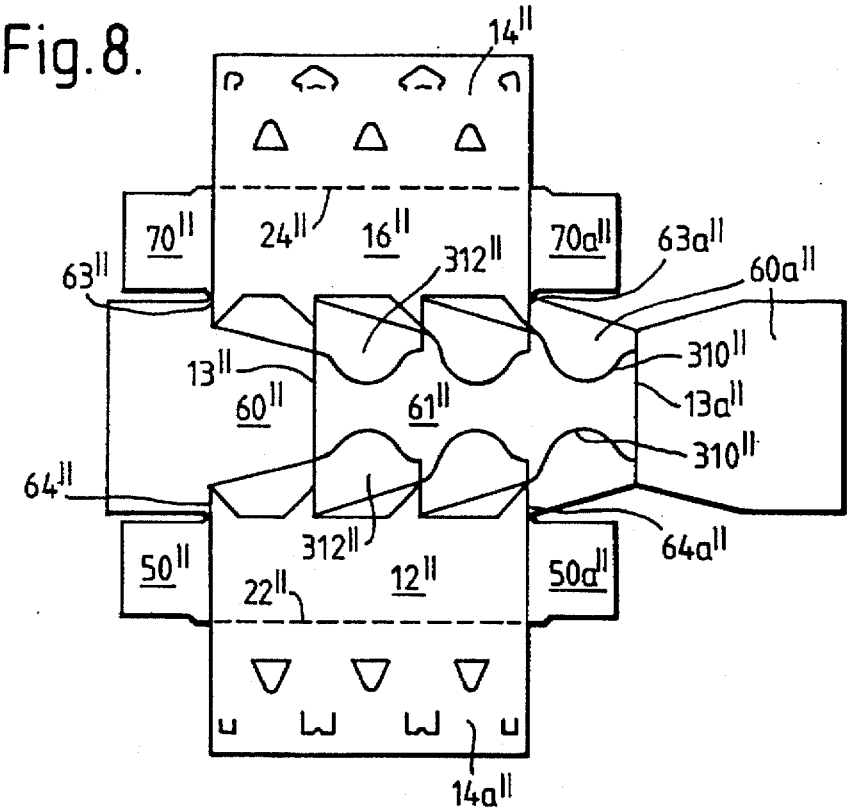
FIG. 8 is a plan view of a blank used to form one of the compartments shown in FIG. 7.
Figure 9:
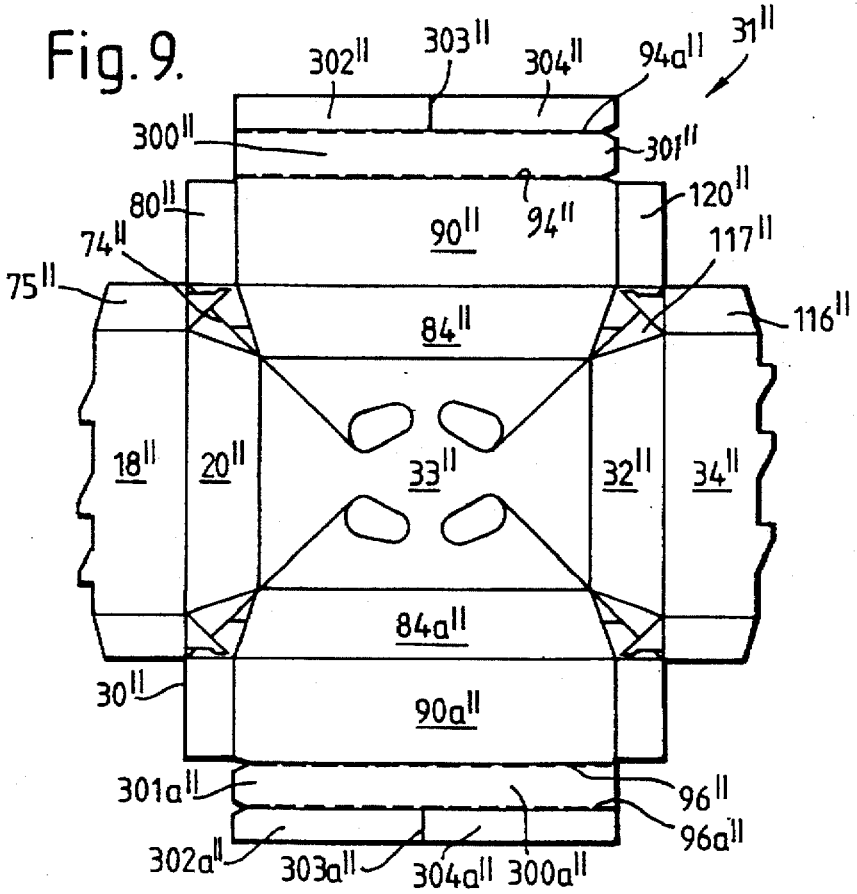
FIG. 9 is a plan view of a cover portion used in combination with the compartments shown in FIG. 7 to form the container shown in FIG. 6

A blank used to form one of these compartments is shown in FIG. 8 in an unformed plan view. To form an erected compartment, end panels 60" and 60A" are respectively folded about hinge lines 64" and 63", and 64A" and 63A" so as to provide an upwardly protruding panel 61". With reference to the view shown in FIG. 8, side wall panels 12" and 16" are then folded downwardly and glue flap 60", 70", 50A" and 70A" are folded inwardly and glued to the inside surfaces of end panels 60" and 60A" respectively. The lap base panels 14" and 14AA" are then folded inwardly so as to overlap and are locked together using locking means of a known mechanical type for example.

The upper panel 61" of compartments 15" and 35" comprises article neck receiving portions 310". Also, depending from the panel 61" are dividers 312" of which separate adjacent bottles in the container.

Once erected, two compartments 15" and 35" are placed adjacent to one another and top panel 31" can be lowered into position. In this embodiment the top panel 31" comprises removable panel 30" which comprises a top panel portion 33", inclined upper side wall panels 22" and 32", and side wall panels 18" and 34". The removable panel 30" also comprises inclined end panels 84" and 84A", and end wall panels 90" and 90A". The cover portion 31" further comprises two tear strips 300" and 300A" and end glue tabs 302", 302A", 304", and 304*a"*. The top cover 31" is formed by folding end panels 18", and 34" downwardly, folding side panels 90" and 90*a"* downwardly and gluing the various pairs of corner glue tabs provided such as 75" and 80" together. The cover portion 31" is then lowered onto the two adjacent compartments 15" and 35" and glue tabs 302", 302A", 304" and 304A" are respectively glued to the associated end wall 60" and 60A" of compartments 15" and 35".

To separate the compartments from one another and remove the cover portion 30" the tear strips 300" and 300A" are torn along their respective tear lines 94" and 94A", and 96" and 96A". The glue tab 302" and 304" are separated from one another by cut 303", similarly end glue tabs 302A" and 304A" are separated by cut 303A", and thus the compartments 15" and 35" are separable as shown in FIG. 7.

The tear strips 300" can comprise a tapered portion such as 301" and 301A" which allow the tear strips to be more easily gripped when separating the removable panel 30" from the compartments 35" and 15".

Again the articles in the compartments are exposed in this embodiment on removal of the removable panel 30".

Figure 7:
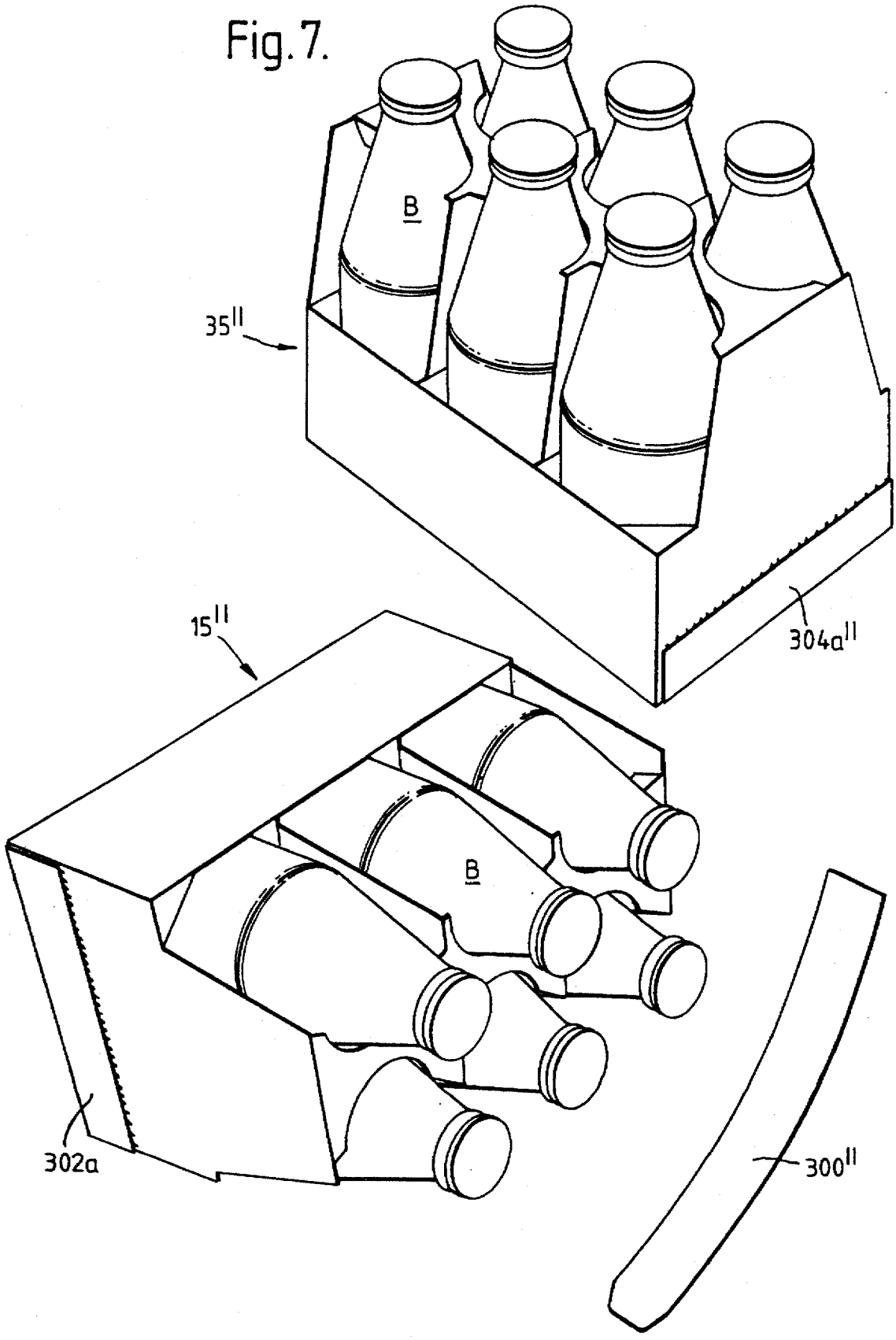
FIG. 7 is a perspective view of two separable compartments as housed in the container shown in FIG. 6.

Additionally the structure of the compartments having a dividing structure enables, amongst other things, the compartments to be laid on their sides as indeed compartment 15" is in FIG. 7.

We claim:

1. A multi-compartment container for packaging a plurality of articles, comprising at least two compartment units and a frangible connecting portion, each of said compartment units comprising a base panel, opposed side panels, opposed end panels and a top panel, wherein certain adjacent panels of said compartment units partly provide said frangible connecting portion so that removal of said connecting portion causes at least partial separation of said units and provides access for removal of the articles contained in said units, wherein upon removal of said connecting portion at least part of each of said panels of said each compartment unit remains intact, wherein said adjacent panels are top panels of respective ones of said units and said connecting portion is a cover portion of the container which bridges said units, and wherein said cover portion comprises a handle for carrying said formed container.

2. A multi-compartment container as claimed in claim 1 wherein removal of said cover portion exposes at least one article in each of said compartment units.

3. A multi-compartment container as claimed in claim 1 wherein said compartment units are attached to one another by a second frangible attachment means.

4. A multi-compartment container as claimed in claim 4 wherein said second frangible attachment means is a connecting tab which is frangibly hinged to one of the compartment units and secured to an adjacent compartment unit.

5. A multi-compartment container as claimed in claim 1 comprising at least one pair of adjacent compartment units in side by side relationship, wherein adjacent side panels of said adjacent compartment units form a keel in a base of the formed container which separates articles between said adjacent units.

6. A multi-compartment container as claimed in claim 1 wherein said cover portion comprises end tabs which are hingably attached to said cover portion and which can be grasped and pulled to remove said cover portion from said container.

7. A multi-compartment container according to claim 1 formed from a single blank.

8. A multi-compartment container according to claim 1 wherein said each compartment unit comprises means for cooperating with at least one of the articles so as to enable a separated compartment unit to be stored on its side.

9. A multi-compartment container as claimed in claim 8 wherein the cooperating means is an article dividing structure.

10. A multi-compartment container as claimed in claim 9 wherein the cooperating means is a compartment top panel.

* * * * *

UNITED STATES PATENT AND TRADEMARK OFFICE

CERTIFICATE OF CORRECTION

PATENT NO. : 5,699,957

DATED : December 23, 1997

INVENTOR(S) : Patrick Blin, Jean-Yves Daniel, Alain Saulas

It is certified that error appears in the above-identified patent and that said Letters Patent is hereby corrected as shown below:

Claim 4, line 1, change "claim 4" to --claim 3--.

Signed and Sealed this

Twenty-seventh Day of April, 1999

*Attest:*

Q. TODD DICKINSON

*Attesting Officer*

*Acting Commissioner of Patents and Trademarks*